US007615977B2

(12) United States Patent
Gicquel et al.

(10) Patent No.: US 7,615,977 B2
(45) Date of Patent: Nov. 10, 2009

(54) LINEAR VOLTAGE REGULATOR AND METHOD OF LIMITING THE CURRENT IN SUCH A REGULATOR

(75) Inventors: Hugo Gicquel, Grenoble (FR); Lionel Vogt, St. Nastin d'heres (FR)

(73) Assignee: STMicroelectronics S.A., Montrouge (FR)

( * ) Notice: Subject to any disclaimer, the term of this patent is extended or adjusted under 35 U.S.C. 154(b) by 252 days.

(21) Appl. No.: 11/801,580

(22) Filed: May 9, 2007

(65) Prior Publication Data

US 2007/0268008 A1 Nov. 22, 2007

(30) Foreign Application Priority Data

May 15, 2006 (FR) ..... 06 51736

(51) Int. Cl.
*G05F 1/40* (2006.01)

(52) U.S. Cl. ..... 323/273

(58) Field of Classification Search ..... 323/273–277, 323/282–285

See application file for complete search history.

(56) References Cited

U.S. PATENT DOCUMENTS 4,972,136 A * 11/1990 Banura ..... 323/275
6,804,102 B2 * 10/2004 Hamon et al. ..... 361/93.3
7,176,664 B1 * 2/2007 Potanin et al. ..... 323/280
7,453,245 B1 * 11/2008 Potanin et al. ..... 323/280
2004/0178778 A1 9/2004 Bansal

FOREIGN PATENT DOCUMENTS

WO WO-01/46768 6/2001

* cited by examiner

*Primary Examiner*—Adolf Berhane
(74) *Attorney, Agent, or Firm*—Gardere Wynne Sewell LLP

(57) ABSTRACT

A linear voltage regulator includes a voltage-regulating circuit that controls a power transistor connected to a load. A current-limiting loop circuit includes a common input/output node that is coupled to a control electrode of the power transistor. The loop senses whether a current representative of the current flowing through the power transistor is above a reference current, and in response thereto delivers a non-zero output current to the control electrode of the power transistor. Otherwise, the loop does not deliver any output current to the control electrode of the power transistor.

23 Claims, 1 Drawing Sheet

LINEAR VOLTAGE REGULATOR AND METHOD OF LIMITING THE CURRENT IN SUCH A REGULATOR

PRIORITY CLAIM

The present application is a translation of and claims priority from French Patent Application No. 06 51736 of the same title filed May 15, 2006, the disclosure of which is hereby incorporated by reference to the maximum extent allowable by law.

BACKGROUND OF THE INVENTION

1. Technical Field of the Invention

The present invention relates to linear voltage regulators that are intended to provide a regulated voltage from a reference voltage and from an unstabilized supply voltage.

2. Description of Related Art

A linear voltage regulator generally includes a power element that operates in its saturated operating region and is connected in series with a load, to which it delivers a stabilized supply voltage $V_{out}$.

FIG. 1 shows a conventional example of a linear regulator. Such a regulator 1 is intended to supply a load Q. It generally comprises an MOS power transistor M intended to be connected in series with the load Q. In general, the transistor M is a pMOS transistor.

The transistor M is controlled in its saturated operating region by a regulating circuit POA, for example based on a differential amplifier that controls the gate voltage $V_g$ applied to the transistor M. A first input, for example the inverting input of the regulating circuit POA, receives a reference voltage $V_{ref}$ and a second input, in the present case the non-inverting input, receives the output voltage $V_{out}$ (this is the regulated voltage), drawn between the drain of the transistor M and the load Q. The voltage $V_{ref}$ is for example provided by a reference circuit capable of delivering a precise stable voltage. The amplifier POA is generally supplied by a voltage $V_{sup}$, for example provided by a battery.

Control of the transistor M is adjusted, by means of the voltage $V_g$ applied to its gate via the output of the regulating circuit POA, as a function of the difference between the values received on the two inputs (inverting and non-inverting), so as to keep the output voltage $V_{out}$ of the regulator constant.

It is useful in linear voltage regulators to limit the value of the current delivered by the transistor M. This makes it possible, when the current drawn by the load increases and consequently the output voltage $V_{out}$ decreases, to prevent the output voltage $V_g$ of the operational amplifier, which controls the transistor, from continuing to drop. This is because decreasing the voltage $V_g$ increases the current delivered by the transistor M above a threshold value, running the risk of damaging both the load Q and the linear regulator.

Conventionally, as shown in FIG. 1, a resistor R is placed between the voltage $V_{sup}$ and the source of the transistor. The voltage across the terminals of the resistor R, which is proportional to the value of the current delivered by the transistor M, is measured and compared by a circuit 3 with a specified voltage threshold. If the circuit 3 detects that the measured voltage is above the voltage threshold, the gate voltage $V_g$ applied to the transistor M is modified so as to limit the current delivered by the transistor M.

However, this solution for limiting the current has the drawback of causing an undesirable voltage drop, and it may pose integration and heat generation problems.

Moreover, document US 2004/0178778 discloses a solution for limiting the current that does not cause such an undesirable voltage drop. This solution comprises the incorporation, into the operational amplifier, of a transistor, at the inverting input stage, and means which, above a certain current level delivered by the transistor, set the output voltage $V_g$ of the amplifier POA that controls the transistor to a given value, thus stopping the current delivered by the transistor M from increasing.

However, because this solution is integrated into the voltage-regulating circuit (in the case disclosed: in the amplifier), it may be limited for regulating circuits that have an architecture similar to that in document US 2004/0178778. There is a need in art for a current limiting solution for use in a linear voltage regulator beyond that shown in the document US 2004/0178778.

SUMMARY OF THE INVENTION

In accordance with an embodiment, a linear voltage regulator comprises a voltage-regulating circuit and a power transistor which is controlled by the output of the regulating circuit and is intended to be connected in series to a load to be supplied. The regulator further includes a current-limiting loop designed to limit the current delivered into the load by the power transistor.

The current-limiting loop includes an input/output node coupled to a control electrode of the power transistor. It is designed, when a current representative of the current delivered by the power transistor is above a reference current, to deliver a non-zero output current and, when the current representative of the current delivered by the power transistor is below the reference current, not to deliver any output current.

The linear voltage regulator thus includes a current-limiting loop that is separate from the voltage-regulating circuit. This current-limiting solution can thus be implemented in regulators having regulating circuits of various architectures.

In one embodiment, the regulating circuit comprises: a differential voltage amplifier having one output and first and second inputs; and a voltage-regulating loop having an input coupled to that electrode of the power transistor which is connected to the load and an output coupled to one input of the power amplifier.

Advantageously, the current-limiting loop is designed to deliver a current, the value of which is equal to the difference between the current representative of the current delivered by the power transistor and the reference current, multiplied by a specified factor. This arrangement makes it possible to set the intensity of the current injected into the connection joining the output of the regulating circuit to the control electrode of the transistor.

In one embodiment, the current-limiting loop includes a second transistor connected as a mirror with the power transistor and having a smaller gate width than the gate width of the power transistor, in order to deliver the current representative of the current delivered by the power transistor. This allows comparison operations relating to the current flowing through the power transistor to be carried out, by manipulating a current of much smaller intensity that is proportional thereto.

Advantageously, the current-limiting loop includes a comparison module designed to compare the current representative of the current passing through the power transistor with the reference current. The comparison module includes a transistor connected as a diode and a current source delivering the reference current, said transistor and said current source being connected in parallel.

In one embodiment, the current-limiting loop further includes a transistor connected as a mirror with the transistor connected as a diode and coupled to one input of a current inverter circuit comprising two transistors connected as mirrors one with respect to the other, the output of said inverter circuit being coupled to the input/output node of the current-limiting circuit.

This thus provides a simple way of achieving the effect of preventing current from being delivered by the output of the current-limiting loop whenever the value of the current representative of the current delivered by the power transistor is not above the value of the reference current.

According to another embodiment, an integrated circuit comprises a regulator in accordance with the foregoing description.

According to another embodiment, a method is presented for limiting the current delivered, into a load to be supplied, by a power transistor of a linear voltage regulator comprising a regulating circuit and a power transistor which is controlled by the output of the voltage-regulating circuit and is intended to be connected in series to the load to be supplied.

The method comprises: determining if a current representative of a current flowing through the power transistor is above a reference current, and in response thereto delivering a non-zero output current, while otherwise, delivering no output current. The operation is implemented by means of a current-limiting loop having an input/output node coupled to a control electrode of the power transistor.

In an embodiment, a linear voltage regulator comprises: a power transistor having a gate terminal and a source/drain circuit for connection in series with a load; a regulating circuit having an output coupled to the gate terminal of the power transistor; and a current limiting loop have a common input/output node coupled to the gate terminal of the power transistor. The current limiting loop comprises: a first circuit having an input coupled to the common input/output node that generates a current representative of a current in the source/drain circuit of the power transistor; a second circuit that compares the representative current to a reference current; and a third circuit having an output that delivers a non-zero output current to the common input/output node if the second circuit determines that the representative current is less than the reference current, and otherwise delivers no output current to the common input/output node.

In another embodiment, a method for limiting a current delivered by a power transistor of a linear voltage regulator into a series connected load comprises: generating, in response to a connection to a control terminal of the power transistor, a current representative of the delivered current from the power transistor; comparing the representative current to a reference current; and delivering a non-zero output current to the control terminal of the power transistor if the comparison indicates that the representative current is less than the reference current, and otherwise delivering no output current to the control terminal of the power transistor.

In yet another embodiment, a linear voltage regulator comprises: a power transistor having a control terminal and outputting a load current; a regulating circuit having an output coupled to the control terminal of the power transistor; and a loop circuit have a common input/output node coupled to the control terminal of the power transistor. The loop circuit comprises: a first transistor having a control terminal coupled to the common input/output node and generating a current representative of a the load current; a comparison circuit that compares the representative current to a reference current; and a current source having an output that delivers a non-zero output current to the common input/output node if the comparison circuit determines that the representative current is less than the reference current, and otherwise delivers no output current to the common input/output node.

BRIEF DESCRIPTION OF THE DRAWINGS

Other features and advantages will become apparent upon reading the description that follows. This is purely illustrative and should be read with regard to the appended drawings in which.

DETAILED DESCRIPTION OF THE DRAWINGS

Figure 1:
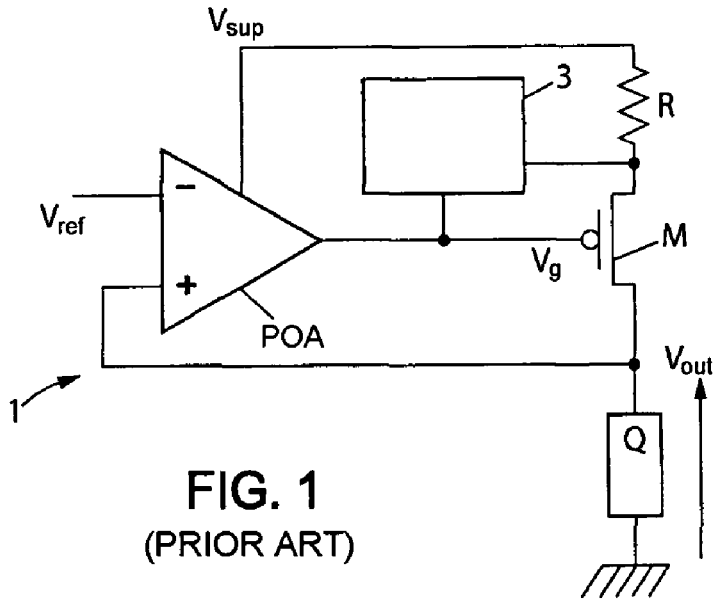
FIG. 1 (PRIOR ART)
FIG. 1, already explained, shows a conventional example of a linear regulator.
Figure 2:
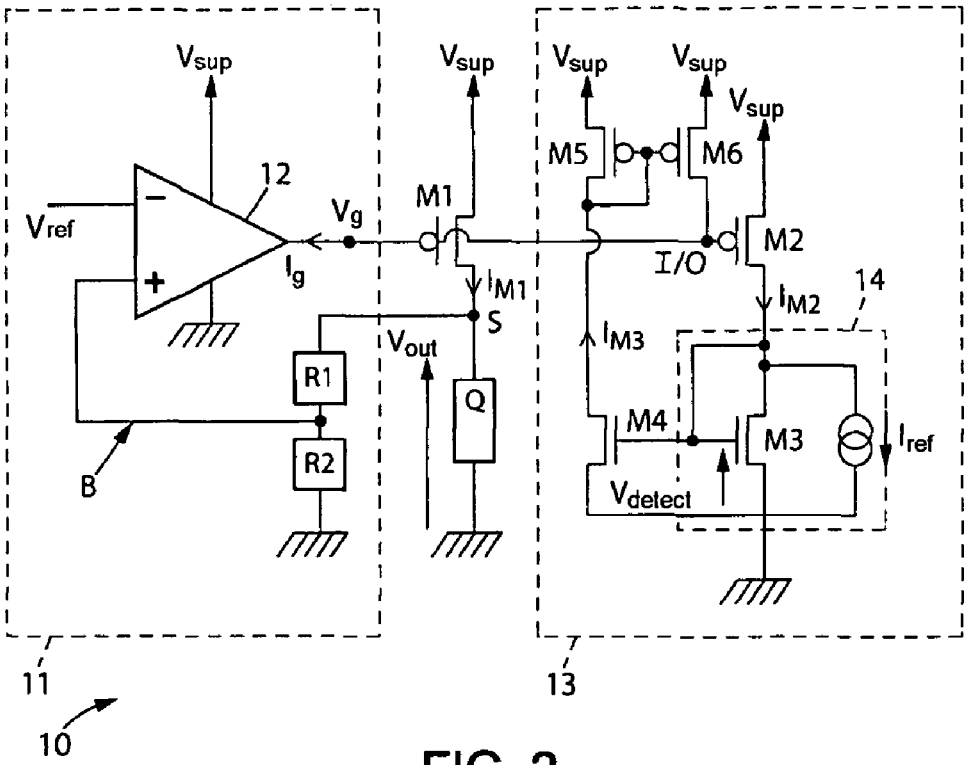
FIG. 2 shows a linear voltage regulator in one embodiment of the invention.

FIG. 2 shows a linear voltage regulator 10 designed to introduce a low drop-out voltage (typically when the difference between the reference voltage and the output voltage of the regulator is less than 2 volts). Such a regulator is called a linear LDO (low drop-out) voltage regulator.

The voltage regulator 10 shown in FIG. 2 is for example included in an integrated circuit. It comprises a voltage-regulating circuit 11, conventionally comprising a differential voltage amplifier 12 connected between a terminal for applying a positive voltage $V_{sup}$ and ground.

The voltage regulator 10 shown in FIG. 2 further includes a power transistor M1, of pMOS type, the source of which is coupled to the $V_{sup}$ terminal and the drain of which is coupled to an output terminal S to which a load Q to be supplied with the regulated voltage $V_{out}$ is connected.

The voltage-regulating circuit 11 is responsible for controlling the power MOS transistor M1 by means of the voltage $V_g$ output by the regulating circuit 11, which voltage is applied to the control electrode, here the gate, of the power transistor M1.

The differential voltage amplifier 12 receives, on one input, in the present case the inverting input, the reference voltage $V_{ref}$ setting the desired value of the regulated voltage, and, on a non-inverting input, the output of a voltage feedback loop B taking, as input, the regulated output voltage $V_{out}$ of the regulator 11, taken off the drain of the transistor M1.

In the case shown, the feedback loop B further includes a voltage divider comprising the resistors R1 and R2, which is introduced between the output terminal S and the non-inverting input of the amplifier 12 so as to obtain a voltage representative of $V_{out}$ and greater than $V_{ref}$ on the non-inverting input of the amplifier 12.

In the embodiment considered with reference to FIG. 2, the linear voltage regulator 10 further includes a current-limiting loop 13 designed to limit the drain current of the transistor M1 to a value equal to $I_{max}$.

The current-limiting loop 13 has an input/output node comprising an input I and an output O that are coincident. It further includes five transistors M2, M3, M4, M5 and M6 and a source providing the reference current $I_{ref}$.

The transistor M2, of pMOS type, is a mirror of the transistor M1. It comprises a proportional replica of the transistor M1. The source of the transistor M2 is connected to the $V_{sup}$ terminal. The transistors M1 and M2 have the same gate length.

The transistor M4 is a mirror of the transistor M3. They have the same gate lengths and are of NMOS type.

The transistor M6 is a mirror of the transistor M5. They have the same gate lengths and are of pMOS type.

The transistors M1, M2, M3, M4, M5 and M6 have respective gate widths $W_{M1}$, $W_{M2}$, $W_{M3}$, $W_{M4}$, $W_{M5}$ and $W_{M6}$.

The ratio of the width of a transistor, for example the width $W_{M2}$ of the transistor M2, to the width of the mirror transistor, in the case of the transistor M2 that of the transistor M1, is equal to the ratio of the respective drain currents delivered by each of the two transistors, in the present case the transistors M1 and M2, when they operate in saturation mode.

The input I is coupled, via the input/output node of the current-limiting loop, to the gate of the power transistor M1. It connects the gate of the transistor Ml to the gate of the transistor M2.

The drain of the transistor M2 is coupled to the input of the comparison circuit 14 of the current-limiting loop 13, which comprises a transistor M3 connected as a diode (the source and drain connected together) and a current source delivering a current $I_{ref}$, connected in parallel with the transistor, and connected between the source and drain of the transistor M3.

The value of the current $I_{ref}$ is chosen so that $I_{ref}$ is equal to $I_{max} \times W_{M2}/W_{M1}$.

The source of the transistor M3 is connected to ground.

The gate of the transistor M3 is coupled to the output of the comparison circuit 14 of the current loop 13.

The transistors M3 and M4 are connected in current mirror mode. Thus, the gate of the transistor M3 is coupled to the gate of the transistor M4, the source of which is connected to ground. The drain of M4 is coupled to the current inverting circuit, comprising the transistors M5 and M6, which are also connected in current mirror mode.

The sources of the transistors M5 and M6 are coupled to the $V_{sup}$ terminal. The gates of the transistors M5 and M6 are coupled. The transistor M5 is connected as a diode and the drain of the transistor M5 is also coupled to the drain of the transistor M4 and the drain of the transistor M6 is coupled to the output O via the input/output node of the current-limiting loop 13.

The operation of the current-limiting loop 13 is described below.

The current $I_{M2}$ is delivered by the transistor M2, which is a mirror of the transistor M1. The current $I_{M2}$, the value of which equals to $I_{M1} \times W_{M2}/W_{M1}$, represents the current $I_{M1}$.

As long as the current $I_{M1}$ delivered by the transistor M1 to the load Q is below $I_{max}$, the current $I_{M2}$ is below $I_{ref}$. Consequently, the voltage $V_{detect}$ between the source and the gate of the transistor M3 is zero. The transistor M3 is therefore not in the on-state. The transistors M4, M5 and M6, being copies of M3, are not in the on-state either.

Thus, as long as the current $I_{M1}$ flowing in the transistor M1 is below $I_{max}$, no current is delivered by the output O of the current-limiting loop 13.

There is therefore no interference with the operation of the regulating circuit 11 and no undesirable energy consumption when the current $I_{M1}$ flowing in the transistor M1 is below $I_{max}$.

When the current $I_{M1}$ flowing in the transistor M1 is above $I_{max}$, the current $I_{M2}$ representative of the current $I_{M1}$ is above $I_{ref}$. Consequently, the voltage between the source and the gate of the transistor M3 becomes positive. The transistor M3 is then in the on-state and the current $I_{M3}$ flowing in the transistor M3 is equal to $I_{M2}-I_{ref}$.

The transistors M4, M5 and M6, being copies of M3, are also in the on-state. The current-limiting loop 13 then delivers in output O a current $I_g$ of positive value equal to:

$$(I_{M1} \times W_{M2}/W_{M1} - I_{ref}) \times ((W_{M4} \times W_{M6})/(W_{M3} \times W_{M5})).$$

The output impedance of the operational amplifier, which was an impedance of relatively high given value (for example 100 kΩ) when no current was injected by the current-limiting loop 13, becomes an impedance of lower value when the current is injected by the current loop (the output transconductance of the OTA then becomes negligible compared with that of the current loop 13).

When the current loop injects a current from its output O, the value of the output impedance of the operational amplifier is then equal to:

$$\frac{1}{G_{mM1}} \times \frac{(W_{M1} \times W_{M3} \times W_{M5})}{(W_{M2} \times W_{M4} \times W_{M6})},$$

where $Gm_{M1}$ is the transconductance of the transistor M1.

The consequence of a current of positive value being injected by the current-limiting loop is to "freeze" the value of the voltage applied to the gate of the transistor M1 by the regulating circuit 11, and thus limits the value of the current $I_{M1}$ delivered by the transistor M1.

For example, in one embodiment of the invention, $V_{sup}$=3.3 volts, $V_{ref}$=2.5 volts, $W_{M1}$=15 mm, $W_{M2}=W_{M3}=W_{M4}=W_{M5}=W_{M6}$=50 μm, $I_{max}$=300 mA, $I_{ref}$=1 mA and $Gm_{M1}$=1.5 siemens (S).

When the value of the current flowing in the transistor M1 exceeds $I_{max}$, the output impedance of the operational amplifier then becomes equal to 200 Ω.

The embodiment described with reference to FIG. 2 employs a technology of the CMOS (complementary metal oxide semiconductor) type, however the circuit could also be employed with a bipolar technology.

The embodiment described with reference to FIG. 2 employs a linear low drop-out voltage regulator. However, the circuit may be applied in the case of any type of linear voltage regulator, whether or not including a differential amplifier. For example, in another embodiment, the linear voltage regulator includes a class D amplifier.

Of course, the gate widths $W_{M1}$, $W_{M2}$, $W_{M3}$, $W_{M4}$, $W_{M5}$ and $W_{M6}$ will have to be chosen so that the output current $I_g$, which is defined as a function of the ratio of these widths, is greater than the maximum output current delivered by the operational amplifier (corresponding for example to the short-circuit current of the regulator when the terminal S of FIG. 2 is connected to ground).

The current-limiting loop is thus separate from the voltage-regulating circuit. The current-limiting function is thus active even when the regulating circuit is inactive or not yet stabilized, for example when it is switched on. The current-limiting solution is thus also compatible with various regulating circuit architectures.

The current-limiting loop is also shorter than the current-limiting circuit of the prior art described for example in document US 2004/0178778. This has the consequence that the current-limiting action of the current-limiting loop according to the invention is more rapid than in the prior art.

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A linear voltage regulator, comprising:

a voltage-regulating circuit;

a power transistor which is controlled by an output of the voltage-regulating circuit; and a current-limiting loop which limits the current delivered into a load by the power transistor, the current-limiting loop including a combination input and output node which is a control electrode of the power transistor, wherein said current-limiting loop operates, when a current representative of the current delivered by the power transistor is above a reference current, to deliver a non-zero output current and, when said current representative of the current delivered by the power transistor is below said reference current, not to deliver any output current.

2. The linear voltage regulator according to claim 1, wherein the voltage-regulating circuit comprises:

a) a differential voltage amplifier having one output and first and second inputs; and b) a voltage-regulating loop having an input coupled to an electrode of the power transistor which is connected to the load and having an output coupled to one input of the power amplifier.

3. The linear voltage regulator according to claim 1, wherein the current-limiting loop delivers a current to the combination input and output node, the value of which is equal to a difference between a current sensed by the loop at the combination input and output node that is representative of the current delivered by the power transistor and the reference current, multiplied by a factor.

4. The linear voltage regulator according to claim 1, wherein the current-limiting loop includes a second transistor connected as a mirror with the power transistor and having a smaller gate width than a gate width of the power transistor, in order to deliver the current representative of the current delivered by the power transistor.

5. The linear voltage regulator according to claim 1, wherein the current-limiting loop includes a comparison module which compares a current sensed by the loop at the combination input and output node that is representative of the current delivered by the power transistor with the reference current, the comparison module including a transistor connected as a diode and a current source delivering the reference current, said transistor and said current source being connected in parallel.

6. The linear voltage regulator according to claim 5, further including a transistor connected as a mirror with the transistor connected as a diode and coupled to one input of a current inverter circuit comprising two transistors connected as a mirror one with respect to the other, an output of said current inverter circuit being coupled to the combination input and output node of the current-limiting loop.

7. An integrated circuit comprising:

a linear voltage regulator, wherein the linear voltage regulator comprises:

a voltage-regulating circuit;

a power transistor which is controlled by an output of the voltage-regulating circuit; and a current-limiting loop which limits the current delivered into a load by the power transistor, the current-limiting loop including a node functioning as both an input node and an output node for the current limiting loop, the node being a control electrode of the power transistor, wherein said current-limiting loop operates, when a current representative of the current delivered by the power transistor is above a reference current, to deliver a non-zero output current and, when said current representative of the current delivered by the power transistor is below said reference current, not to deliver any output current.

8. A method of limiting a current delivered by a power transistor of a linear voltage regulator into a series connected load, wherein the linear voltage regulator comprises a voltage-regulating circuit and a power transistor which is controlled by an output of the voltage-regulating circuit, comprising:

operating a current-limiting loop having a combination input and output node which is a control electrode of the power transistor so that a non-zero output current is delivered if a current representative of a current delivered by the power transistor is above a reference current, and otherwise delivering no output current.

9. The method according to claim 8, wherein the voltage-regulating circuit includes a differential voltage amplifier having one output and first and second inputs, and wherein operating comprises connecting an input of a voltage-regulating loop to one electrode of the power transistor which is connected to the load and connecting an output to one input of the power amplifier.

10. The method according to claim 8, further comprising determining a difference between the current representative of the current flowing through the power transistor and the reference current, multiplying a current of the determined difference by a factor and delivering the multiplied current.

11. The method according to claim 8, wherein delivering the current representative of the current passing through the power transistor comprises using a second transistor connected as a mirror to the power transistor and having a smaller gate width than the gate width of the power transistor.

12. The method according to claim 8, wherein comparing the current representative of the current flowing through the power transistor and the reference current is carried out by using a transistor connected as a diode and of a current source delivering the reference current, said transistor and said current source being connected in parallel.

13. The method according to claim 12, wherein the delivered output current is provided by the output of a current inverter circuit comprising two transistors connected as mirrors one with respect to the other, the input of said inverter circuit being coupled to a transistor connected as a mirror to the transistor connected as a diode.

14. A linear voltage regulator, comprising:

a power transistor having a gate terminal and a source/drain circuit for connection in series with a load;

a regulating circuit having an output coupled to the gate terminal of the power transistor; and a current limiting loop having a common input/output node that is the gate terminal of the power transistor, the current limiting loop comprising:

a first circuit having an input coupled to the common input/output node that generates a current representative of a current in the source/drain circuit of the power transistor;

a second circuit that compares the representative current to a reference current; and a third circuit having an output that delivers a non-zero output current to the common input/output node if the second circuit determines that the representative current is less than the reference current, and otherwise delivers no output current to the common input/output node.

15. The linear voltage regulator of claim 14 wherein the second circuit comprises a first current mirror circuit having a first input and a first output and a reference current generator connected to the first current mirror circuit.

16. The linear voltage regulator of claim 15 wherein the first current mirror circuit comprises a first diode connected transistor have a source/drain circuit, the reference current generator being coupled in parallel with the source/drain circuit of the first diode connected transistor.

17. The linear voltage regulator of claim 15 wherein the third circuit comprises a second current mirror circuit having a second input, which is coupled to the first output of the first current mirror circuit, and a second output, which is coupled to the common input/output node.

18. The linear voltage regulator of claim 14 wherein the first circuit comprises a transistor which is a proportional replica of the power transistor and includes a gate terminal coupled to the common input/output node and a source/drain circuit coupled to the second circuit.

19. The linear voltage regulator of claim 14 wherein the linear voltage regulator is included within an integrated circuit chip.

20. A linear voltage regulator, comprising:

a power transistor having a control terminal and outputting a load current;

a regulating circuit having an output coupled to the control terminal of the power transistor; and a loop circuit having a common node functioning as both input to and output from the loop circuit, the common node being the control terminal of the power transistor, the loop circuit comprising:

a first transistor having a control terminal coupled to the common input/output node and generating a current representative of a the load current;

a comparison circuit that compares the representative current to a reference current; and a current source having an output that delivers a non-zero output current to the common input/output node if the comparison circuit determines that the representative current is less than the reference current, and otherwise delivers no output current to the common node functioning as both input to and output from the loop circuit.

21. The linear voltage regulator of claim 20 wherein the comparison circuit comprises a first current mirror circuit having a first input receiving the representative current and a first output; and a reference current generator connected to the first current mirror circuit.

22. The linear voltage regulator of claim 21 wherein the current source is a component of a second current mirror circuit having a second input, which is coupled to the first output of the first current mirror circuit.

23. The linear voltage regulator of claim 21 wherein the first transistor which is a proportional replica of the power transistor.

* * * * *